US006244038B1

(12) United States Patent
Brännström et al.

(10) Patent No.: US 6,244,038 B1
(45) Date of Patent: Jun. 12, 2001

(54) POWER PLANT WITH FUEL GAS GENERATOR AND FLUIDIZED BED COMBUSTION

(75) Inventors: Roine Brännström; Anders Lövgren; Dirk Veenhuizen, all of Finspång (SE)

(73) Assignee: Asea Brown Boveri AB, Vasteras (SE)

( * ) Notice: Subject to any disclaimer, the term of this patent is extended or adjusted under 35 U.S.C. 154(b) by 0 days.

(21) Appl. No.: 09/254,735

(22) PCT Filed: Sep. 12, 1997

(86) PCT No.: PCT/SE97/01544

§ 371 Date: Apr. 29, 1999

§ 102(e) Date: Apr. 29, 1999

(87) PCT Pub. No.: WO98/12474

PCT Pub. Date: Mar. 26, 1998

(30) Foreign Application Priority Data

Sep. 17, 1996 (SE) ..... 9603382

(51) Int. Cl.[7] ..... F02C 3/28
(52) U.S. Cl. ..... 60/39.12; 60/736
(58) Field of Search ..... 60/39.12, 39.464, 60/736

(56) References Cited

U.S. PATENT DOCUMENTS

| | | | | |
|---|---|---|---|---|
| 3,991,557 | * | 11/1976 | Donath | 60/39.12 |
| 4,253,409 | | 3/1981 | Wormser | 110/347 |
| 4,470,255 | * | 9/1984 | Rowlands et al. | 60/39.12 |
| 4,896,497 | | 1/1990 | Pillai | 60/39.12 |
| 5,134,841 | | 8/1992 | Rehwinkel et al. | 60/39.02 |
| 5,469,698 | * | 11/1995 | Garcia-Mallol | 60/39.12 |

FOREIGN PATENT DOCUMENTS

| | | |
|---|---|---|
| 0 468 357 A1 | 1/1992 | (EP) . |
| 0 503 772 A2 | 9/1992 | (EP) . |
| 0 616 114 A2 | 9/1994 | (EP) . |
| 2 095 762 | 10/1982 | (GB) . |
| 458 955 | 5/1989 | (SE) . |

* cited by examiner

*Primary Examiner*—Louis J. Casaregola
(74) *Attorney, Agent, or Firm*—Connolly Bove Lodge & Hutz LLP

(57) ABSTRACT

A combustion plant for a combustion process is disclosed. The plant has a pressurized combustion chamber (1), which encloses a fluidized bed and in which combustion of a fuel is to take place while producing combination gases, a gasifying device (40), which is arranged to produce a combustible gas and a degassed combustible product, and a transportation device (6, 44) for discharging the product from the gasifying device (40) and supplying it to the combustion chamber (1) for combustion of the product in the combustion chamber. The transportation device has a discharge conduit (44) connected to the gasifying device (40) and is arranged to discharge the product from the gasifying device (40). The discharge conduit (44) has a cooling member (45), which is arranged to cool the product discharged from the gasifying device (40), and a pneumatic supply conduit device. The pneumatic supply conduit device (6) is arranged downstream of the cooling member (45) to connect the discharge conduit (44) to the combustion chamber (1) and supply the product to the combustion chamber using a pressurized gas. The pressurized gas contains oxygen supplied directly to the supply conduit device (6) by a compressor (16, 51).

12 Claims, 3 Drawing Sheets

POWER PLANT WITH FUEL GAS GENERATOR AND FLUIDIZED BED COMBUSTION

THE BACKGROUND OF THE INVENTION AND PRIOR ART

The present invention relates to a combustion plant for a combustion process, comprising a combustion chamber in which combustion of a fuel is to take place while producing combustion gases, a gasifying device which is arranged to produce a combustible gas and a degassed combustible rest product, and transportation means which are arranged to discharge said rest products from the gasifying device and supply it to the combustion chamber for combustion of the rest product in the combustion chamber.

The present invention will now be discussed and enlightened in different applications in connection to a pressurized fluidized bed, a so called PFBC-power plant (Pressurized Fluidized Bed Combustion). However, the invention is not delimited to such applications, but can be employed in all possible types of heat and power plants, for example in connection to different types of gas turbine plants.

It is known to combust different fuels in a bed of particulate, non-combustible material which is supplied with combustion air from below through nozzles in such a way that the bed becomes fluidized. The combustion gases formed during the combustion process pass a freeboard above the bed, whereafter they are purified and guided to a gas turbine. The combustion gases drive the gas turbine which in its turn drives an electric generator on one hand and a compressor which supplies the pressure vessel with compressed air on the other hand. In the bed the fuel is combusted at a temperature in the order of 850° C. To be able to maintain this temperature at a required level it is known to arrange an additional combustion in the freeboard above the bed. This additional combustion may take place by means of a burner in which the combustible gas from a gasifying plant is combusted. By such a gasifying plant it is known to gasify coal and produce said combustible gas and a degassed rest product, such as coke ("char coal"). This rest product can be delivered to the combustion chamber and be combusted in the fluidized bed. However, it is difficult to transport the degassed rest product from the gasifying device to the combustion chamber because the rest product has a very high temperature and is also combustible. This means that valves and other control members that are necessary for this transport must be made of temperature-resistant and accordingly, expensive materials. Moreover, the degassed rest product cannot be transported by means of air due to the risk of self-ignition, but instead inert gases, such as nitrogen, must be employed, also resulting in the operation of the plant becoming expensive.

SE-B-458 955 shows a PFBC-plant with a pressure vessel in which a combustion chamber and a gasifying reactor are arranged. The combustible gases generated in the gasifying reactor are conducted to a topping combustion chamber located outside the pressure vessel and for increasing the temperature of the combustion gases before these ones are conducted to a gas turbine. The combustion chamber and the gasifying reactor are only separated by a separation wall which, in its bottom part, permits passage of combustible material between the gasifying reactor and the combustion chamber.

SUMMARY OF THE INVENTION

The object of the present invention is to remedy the above problems and more precisely to accomplish a combustion plant with a gasifying device the degassed rest product of which can be taken advantage of in a simple way and combusted in the combustion chamber of the combustion plant.

This object is obtained by the combustion plant initially defined, which is characterized by means which are arranged to cool said rest product which is discharged from the gasifying device. Through the inventive measure the handling of the degassed rest product is substantially facilitated. The rest product can now be transported by means of conventional aids, such as for example pressurized air, without the risk of self-ignition in the transportation system. Furthermore, the valves and control members employed to control the supply of the rest product to the combustion chamber may be of a conventional type and, accordingly, do not need to be adjusted to high temperatures.

According to one embodiment of the invention, said cooling means are connected to means which are arranged to recover the heat gained during the cooling of the rest product in said process. In that way the total efficiency of the combustion plant can be kept at a high level. Thereby, said recovery means may advantageously be arranged to heat the fuel before it is fed into the combustion chamber. By preheating and drying the fuel, for example coal, in this way before it is supplied to the combustion chamber, also the combustion in the fluidized bed is facilitated. Furthermore, the plant may comprise means for feeding an absorbent into the combustion chamber, the recovery means possibly being arranged to heat the absorbent before it is fed into the combustion chamber.

According to another embodiment of the invention, a circuit conduit is arranged to conduct a medium between said cooling means and said recovery means, said cooling means being arranged to transmit the heat of the rest product to said medium, and the recover y means being arranged to emit the heat of the medium.

According to another embodiment of the invention, said transportation means comprise a supply conduit downstream of said cooling means, which conduit is connected to the combustion chamber and arranged to supply the combustion chamber with said rest product by means of pressurized gas containing oxygen. Thanks to the inventive cooling such a gas containing oxygen can be employed without any risk of self-ignition in the supply conduit. The employment of such gas containing oxygen, such as for example air, is favourable in comparison to the employment of other inert gases in this context such as for example nitrogen gas, as it is often accessible and also the cheapest one. Advantageously, said transportation means comprise a discharge conduit with a discharging device which is arranged to make a continuous discharge of the combustible rest product from the gasifying device possible. Thereby, advantageously, the discharge conduit comprises said cooling means, and these are arranged upstream of the discharging device. In that way, the discharging device can be made of relatively simple components comprising a first valve member, a container arranged downstream of the first valve member, and a second valve member arranged downstream of the container.

According to another embodiment of the invention an additional combustion device is arranged to make a control of the temperature of the combustion gases possible through combustion of the combustible gas. Thereby, a channel member may be arranged to conduct said combustion gas from the combustion chamber to one or more gas turbine steps for extracting energy therefrom, the additional combustion device being arranged in the channel member upstream of at least one of the gas turbine steps. In that way the combustion gases can be given a temperature which corresponds to optimum operational conditions for the gas turbine, that is a temperature of approximately 1200–1500° C. Furthermore, the combustion chamber may be enclosed in a pressure vessel and enclose a pressurized fluidized bed, the additional combustion device possibly comprising a burner which is arranged to accomplish a combustion in the combustion chamber in a space downstream of the bed. In that way the possibilities to control the temperature in the combustion chamber, especially at a low load, are improved, and it can be made sure that the combustion gases leaving the combustion chamber always have generally the same temperature.

BRIEF DESCRIPTION OF THE DRAWINGS

The present invention will now be explained more in detail by means of different embodiments shown by way of example and with reference to the enclosed drawing figures.

DETAILED DESCRIPTION OF DIFFERENT EMBODIMENTS

Figure 1:
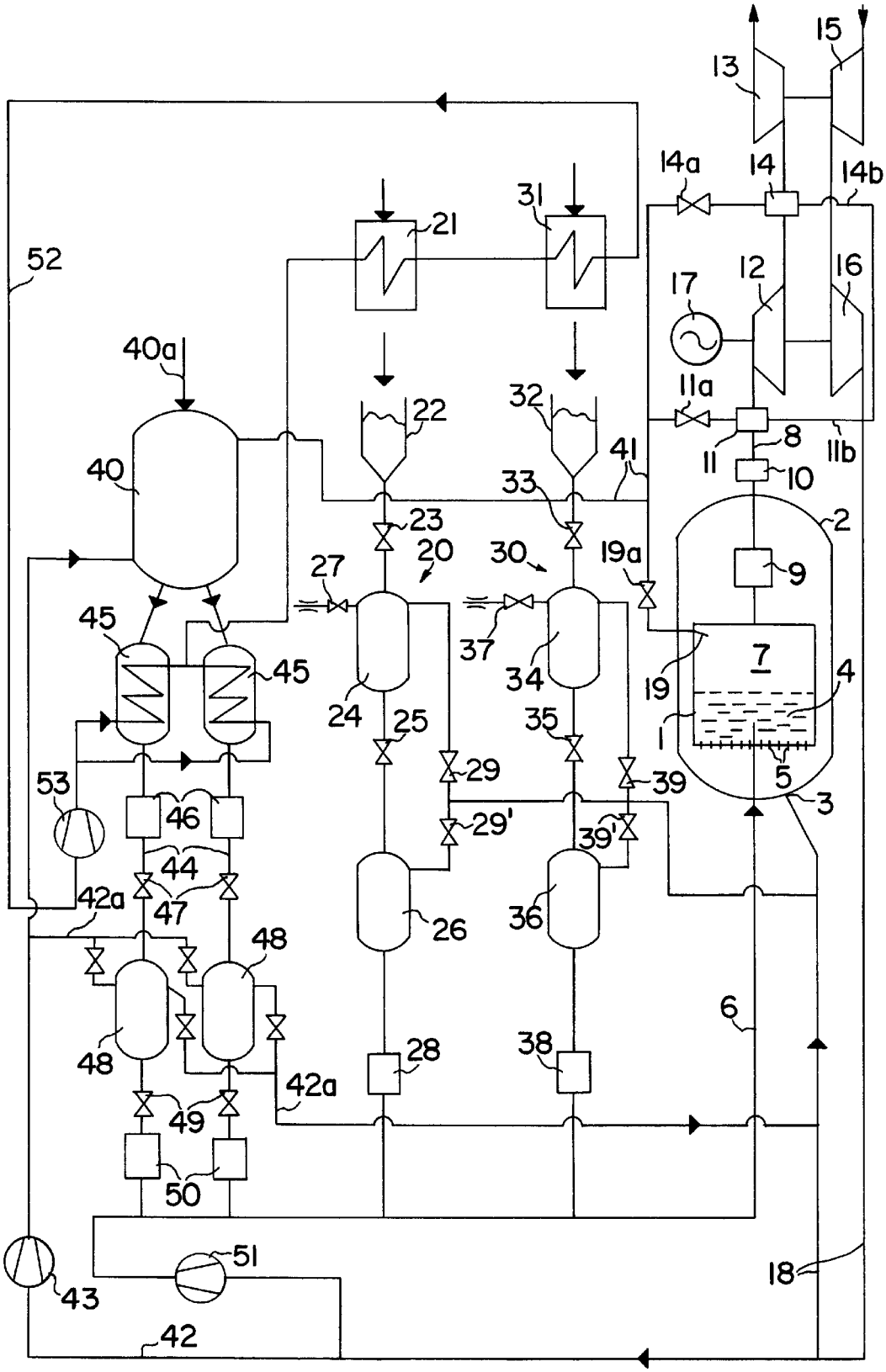
FIG. 1 schematically shows a combustion plant according to the invention.

The invention will now be explained with reference to a so called PFBC-power plant. It shall, however, be noted that the invention is applicable also to other types of plants. Such a PFBC-power plant, that is a plant for the combustion of particulate fuel in a pressurized fluidized bed, is schematically shown in FIG. 1. The plant comprises a combustion chamber 1 which is located in a pressure vessel 2, which may have a volume in the order of $10^4 m^3$ and which can be pressurized up to for example between 7 and 30 bar (abs). Compressed gas containing oxygen, air in the example shown, is supplied to the pressure vessel 2 at 3 for the pressurizing of the combustion chamber 1 and for fluidizing a bed 4 in the combustion chamber 1. The compressed air is supplied to the combustion chamber 1 via schematically indicated fluidizing nozzles 5 which are arranged at the bottom of the combustion chamber 1 in order to fluidize the bed 4 enclosed in the combustion chamber 1. The air is supplied such that a fluidizing velocity of approximately 0.5–2.0 m/s is obtained. The bed 4 is of a bubbling type and has a height which is approximately 2–6 m. The bed 4 comprises a non-combustible particulate bed material, a particulate absorbent and a particulate fuel. The particle size of the bed material, the absorbent and the fuel is between approximately 0.5 and 7 mm. The bed material comprises, by way of example, ash and/or sand, and the absorbent comprises calcareous material, for example dolomite or lime stone for the absorption of the sulphur and possible other unwanted agents that are released during the combustion. The fuel is supplied to such an amount that it constitutes approximately 1% of the bed 4. Fuel is referred to as all combustible fuels that can burn, for example stone coal, brown coal, coke, peat, biofuel, oil shale, petroleum coke, waste, oils, hydrogen gas and other gases, etc. The absorbent and the fuel is supplied to the bed via a schematically shown conduit 6. The fuel is combusted in the fluidizing air conducted to the bed 4 while forming combustion gases. These gases are gathered in a space 7, a so called freeboard, above the bed 4 and are then conducted via the channel member 8 to different, schematically shown purifying steps constituted by a cyclone separator 9 and a high temperature filter 10. Therefrom the combustion gases are conducted to a topping combustion chamber 11 in order to increase the temperature of the combustion gases before they are conducted into a high pressure turbine 12. The combustion gases expanded in the high pressure turbine 12 are guided to a low pressure turbine 13. Between the high pressure turbine 12 and the low pressure turbine 13 an additional combustion device in the shape of a reheating combustion chamber 14 may be arranged to increase the temperature of the combustion gases leaving the high pressure turbine 12. The low pressure turbine 13 is arranged on the same shaft as a low pressure compressor 15 which, in a first step, compresses the combustion air used in the plant. The combustion air leaving the low pressure compressor 15 is compressed in a second step in a high pressure compressor 16 which is arranged on the same shaft as the high pressure turbine 12 and, accordingly, is driven by said turbine. On this shaft there is also a generator 17 for the extraction of electric energy. The combustion air is conducted from the high pressure compressor 16 via the conduit 18 to the pressure vessel 2 and the combustion chamber 1.

The inventive plant also comprises a fuel supply conduit 20 through which the fuel is supplied to the supply conduit 6 for feeding into the combustion chamber 1. The fuel supply conduit 20 comprises a heating member 21 for preheating and drying the supplied fuel, for example crushed coal. The heating member 21 will be described more in detail hereinafter. The fuel supply conduit 20 further comprises a collecting container 22, a first valve 23, a first tank 24, a second valve 25 and a second tank 26. Moreover, there is a venting valve 27 with an associated throttling to lower the pressure in the first tank 24. Downstream of the second tank 26 a feeding member 28, for example in the shape of a cell feeder, is arranged. Furthermore, the pressure in the first and second tanks 24, 26 can be controlled through the connection of the tanks 24, 26 with the pressurized combustion air in the conduit 18 by means of the valves 29 and 29', respectively. It shall be noted that the fuel supply arrangement shown only is an example and that the fuel supply conduit 20 can be constructed in many different ways by means of different components. With the fuel supply conduit 20 shown the fuel supply can take place in the following way. In a starting position, the collecting container 22 which is under atmospheric pressure has been filled with fuel, the valves 23, 25 and 29 being closed and the valve 27 being open to accomplish a pressure which is the same as the atmospheric pressure in the tank 24. Thereafter, the valve 23 is opened and the fuel is transported to the tank 24. The valve 27 is closed and when the tank 24 is sufficiently filled, also the valve 23 is closed. Now the valve 29 is opened and the tank 24 is pressurized. When generally the same pressure is present in the tanks 24 and 26, the valve 25 is opened and the fuel located in the tank 24 is transported to the tank 26. Thereafter, the valve 25 is closed and the fuel located in the tank 26 is discharged by means of the feeding member 28, the pressure in the tank 26 being controlled by means of the valve 29' such that the pressure fall over the feeding member 28 is generally equal to zero. The discharged fuel is then supplied to the fuel supply conduit 6 and the process can start again. It shall be noted that the fuel supply conduit 20 shown permits fuel to be supplied to the tank 24 while fuel is discharged from the tank 26.

The inventive combustion plant may also comprise an absorbent supply conduit 30 which has the same structure as the fuel supply conduit 20. Accordingly, it comprises a heating member 31, a collecting container 32, a first valve 33, a first tank 34, a second valve 35, a second tank 36, a venting valve 37, a feeding member 38 and pressurizing valves 39, 39'. The supply of absorbent takes place in the same way as the fuel supply and will therefore not be described more in detail.

The inventive combustion plant further comprises a gasifying device in the shape of a gasifying reactor 40 which is arranged to produce a combustible gas and a degassed combustible rest product, for example coke. The gasifying reactor 40 is supplied with a fuel through an introduction conduit 40*a* and can be driven with the same fuel as the combustion chamber 1, for example crushed coal. The combustible gas is employed in the combustion process for the combustion taking place in the topping combustion chamber 11, the reheating combustion chamber 14 and the burner 19. These combustion members are supplied with the combustible gas via the conduit 41, and the supply is controlled by means of respective valves 11*a*, 14*a* and 19*a*. It shall be noted that the combustion chambers 11 and 14 also are supplied with combustion air from the conduit 18 via the conduits 11*b* and 14*b*, Also the gasifying reactor 40 is supplied with combustion air from the conduit 18 via the conduit 42 which comprises a booster compressor 43 which is arranged to increase the pressure in the gasifying reactor such that there is a higher pressure than the pressure present in the pressure vessel 2 and, accordingly, is between approximately 23 and 35 bar (abs). The combustion in the gasifying reactor 40 takes place substoichiometrically. The degassed rest product obtained in the gasifying reactor 40 still has a high energy value and thus can be taken advantage of for a combustion in the combustion chamber 1.

In order to make this possible the inventive combustion plant comprises transportation means in the shape of two parallel discharge conduits 44. The two parallel discharge conduits 44 have a generally identical structure and therefore only one of them will be described more in detail. Because the degassed rest product obtained in the gasifying reactor has a very high temperature it shall, according to the present invention, be cooled to permit to be handled in a convenient and simple way. Accordingly, to accomplish this cooling, the discharge conduit 44 comprises means in the shape of a cooling member 45 which will be described more in detail hereinafter. The cooling member 45 is arranged in direct connection to the gasifying reactor 40. Downstream of the cooling member 45 the discharge conduit 44 comprises a feeding member 46, a first valve 47, a tank 48, a second valve 49 and a second feeding member 50. Downstream of the second feeding member 50 the discharge conduit 44 is connected to the common supply conduit 6. This conduit 6 is pressurized through a connection to the conduit 18. Furthermore, the supply conduit 6 comprises a booster compressor 51, by means of which the pressure in the supply conduit 6 can be increased above the level existing in the pressure vessel 2 and the combustion chamber 1. In that way the combustible rest product, the fuel and the absorbent can be supplied to the combustion chamber 1 by means of so called pneumatic transportation by means of pressurized combustion air.

During discharge of the combustible rest products through one of the discharge conduits 44 the valve 47 is opened and the valve 49 is closed. Thereby, the tank 46 has been pressurized through a valve-provided branch conduit 42*a*. By means of the feeding member 46 the rest product is fed down into the tank 48. When the tank 48 is filled, the valve 47 is closed and the valve 49 is opened- Thereby, the pressure in the tank 48 has been adapted to the pressure existing in the pressure vessel 2 by means of the valve-provided branch conduit 42*a*. Thereafter, the rest product is discharged from the tank 48 by means of the feeding member 50 and is thus supplied to the common supply conduit 6 for a pneumatic transportation to the combustion chamber 1. Thanks to the two parallel discharge conduits 44, the combustible rest product can be discharged continuously and be supplied continuously to the supply conduit 6, as during filling of one of the tanks 48 the other tank 4B is emptied. It is also possible to arrange these transportation means for the rest product in another way, for example with only one discharge conduit with two tanks arranged in series in a similar way as by the fuel supply conduit 20.

The cooling members 45, the heating member 21, and the heating member 31 make part of a closed heat transmission circuit which comprises a circuit conduit 52 and a pump device 53 to drive a heat transmitting medium between the cooling members 45 and the heating members 21, 31 through the circuit conduit 52. This medium may be in a gaseous or liquid state and for example comprise water/water steam or any oil-like liquid. When the rest product is discharged from the gasifying reactor 40 it will thus give off a part of its heat content to this medium in the cooling members 45. The warm medium is then transported to the heating members 21 and 31, where the medium in its turn gives off a part of its heat content to the fuel and the absorbent, which are to be supplied to the combustion chamber 1. Thereafter, the medium is further transported via the pump member 53 back to the cooling members 45 and so on. In that way, the discharged rest product that may have a temperature of approximately 900° C. will be cooled to approximately 300° C. , and thereby the rest product can be transported and handled by means of the shown valve members and the feeding members constructed in a conventional way. Furthermore, the risk for self-ignition of the rest product in the supply conduit 6 which is fed with gas containing oxygen is set aside. Moreover, the introduced fuel and the introduced absorbent will be dried and given a temperature of approximately 200° C.

In many applications of the inventive combustion plant, the amount of fuel introduced through the fuel supply conduit 20 will be substantially more important than the amount of rest product that is discharged through the discharge conduits 44. In that way, by means of the shown arrangements, it is assured that a sufficient amount of chill always will exist for the cooling of the rest product to a suitable temperature. Of course this is even more relevant if also the supplied absorbent is preheated.

Figure 2:
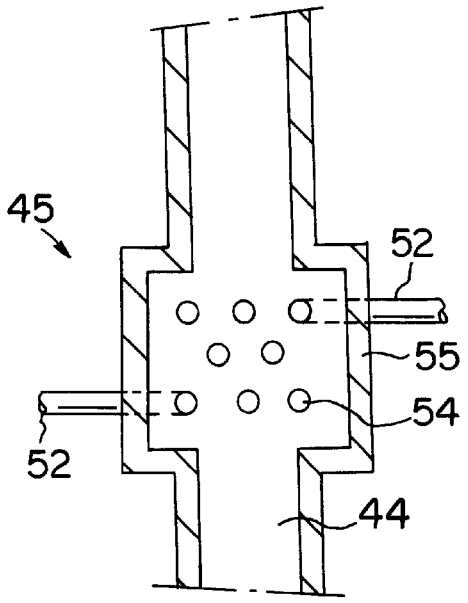
FIG. 2 shows a sectional view of a cooling member in the shape of a heat exchanger of the combustion plant in FIG. 1 according to an embodiment of the invention.

FIG. 2 shows an example of how the cooling members 45 may be constructed. They may comprise a container-like expansion of the discharge conduit 44 The incoming circuit 52 is conducted in a loop 54 in the container-like expansion and further out through the out-going circuit 52. As can be seen in FIG. 2 the discharge conduit 44 and the expansion comprises a heat-insulated wall 55. It shall be noted that the cooling members 45 may be constructed in many ways. What is substantial is that they make the transmitting of a part of the heat of the rest product to the heat transmitting medium in the circuit conduit 52 possible in an effective way.

Figure 3:
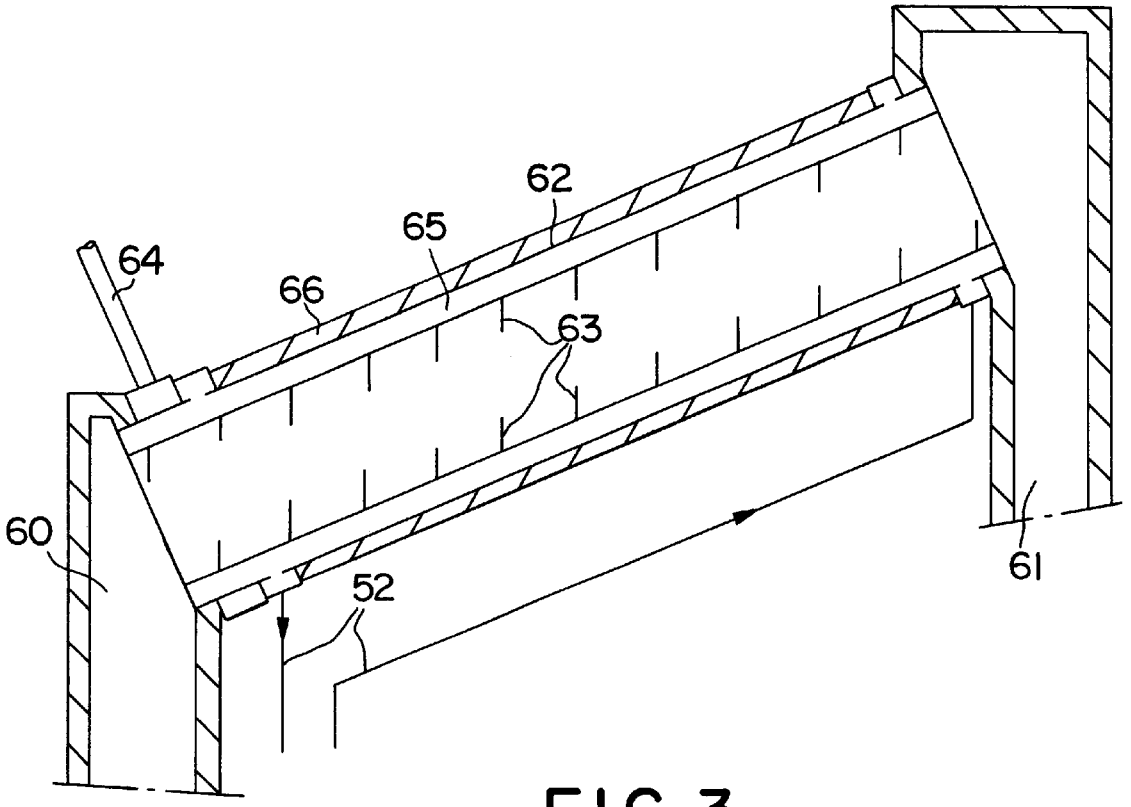
FIG. 3 shows a sectional view of a heating member in the shape of a rotating drum of the combustion plant in FIG. 1 according to one embodiment of the invention.

FIG. 3 shows an example of the construction of the heating member 21. It shall be noted that the heating member 31 can be constructed in the same way as the heating member 21, and therefore only one of these will be described. The heating member 21 shown comprises an inlet channel 60 and an outlet channel 61 which form a part of the fuel supply conduit 20. Between these channels a rotating drum 62 is arranged. On its inside The drum 62 comprises helically arranged flanges 63 which contribute to transport the fuel introduced through the introduction conduit 60 obliquely upwards in the drum 62. The rotating drum. 62 is driven by means of a schematically shown worm gear 64 and a driving motor not shown. The wall of the drum 62 comprises a space 65 through which the medium of the circuit conduit 52 can circulate and flow in opposite direction to the fuel. Furthermore, on the outside of the drum 62, an insulation 66 is arranged. In that way the heat of the medium will be transferred to the fuel which is transported through the drum 62 and contribute to the drying and preheating thereof.

Figure 4:
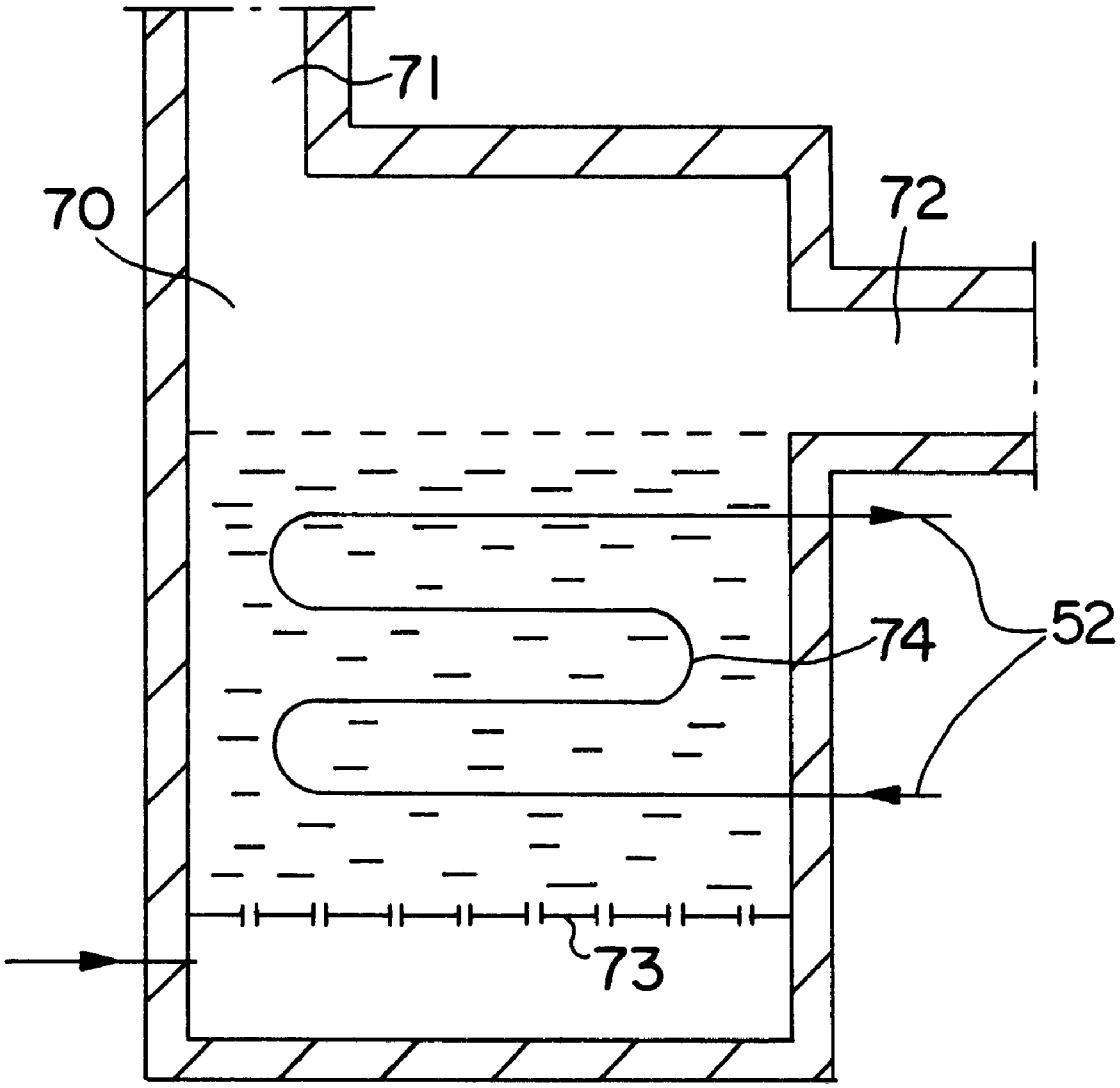
FIG. 4 shows a sectional view of a heating member shape of a fluidized bed of the combustion FIG. 1 according to another embodiment invention.

FIG. 4 shows a heating member 21, 31 according to another embodiment. This heating member 21 comprises a chamber 70 with an inlet 71 and an outlet 72, which may form a part of the fuel supply conduit 20. At the bottom of the chamber a plate 73 is arranged, which plate comprises a large amount of nozzles. Below the plate 73 air is supplied, whereby the fuel existing in the chamber 70 will be fluidized. In the fluidized bed the circuit conduit 52 extends in a tube loop 74 and thus contributes to the drying and heating of the fuel. It shall be noted that the heating members 21 and 31 also can be constructed in other ways than those shown in FIGS. 3 and 4. Furthermore, the heating members 21 and 31 may be differently constructed with reference to each other to be adapted to heating of the fuel and the absorbent, respectively.

The present invention is not restricted to the above embodiments, but can be varied and modified within the frame of the following patent claims. For example, the inventive combustion plant may be applied without any of or with a plurality of the additional combustion devices 11, 14, 19. The circuit conduit 52 shown is designed as a continuous circuit, but the invention is applicable also with an open circuit. The two heating members 21 and 31 may also be arranged parallel to each other with reference to the circuit conduit 52.

The heat taken advantage of during the cooling of the rest product may also be employed for other objects in the combustion plant according to the invention, for example for heating of combustion air.

It shall also be noted that the invention also is applicable when only a part of the fuel and the absorbent is preheated.

What is claimed is:

1. A combustion plant for a combustion process, comprising a pressurized combustion chamber (1) which encloses a fluidized bed and in which combustion of a fuel is to take place while producing combustion gases, a gasifying device (40) which is arranged to produce a combustible gas and a degassed combustible product, and a transportation means (6, 44) for discharging said product from the gasifying device (40) and supplying it to the combustion chamber (1) for combustion of the product in the combustion chamber, wherein said transportation means comprises a discharge conduit (44) connected to the gasifying device (40) and arranged to discharge said product from the gasifying device (40), characterized in that the discharge conduit (44) comprises at least one cooling member (45), which is arranged to cool said product which is discharged from the gasifying device (40), and a pneumatic supply conduit means (6), arranged downstream of said cooling member (45), for connecting the discharge conduit (44) to the combustion chamber (1) and supplying said product to the combustion chamber using a pressurized gas containing oxygen supplied directly to the supply conduit means (6) by a compressor (16, 51).

2. A combustion plant according to claim 1, characterized in that said cooling member (45) is connected to means (52, 21, 31) which are arranged to recover the heat gained during the cooling of the product in said process.

3. A combustion plant according to claim 2, characterized in that said recovery means (21) are arranged to heat the fuel before it is introduced into the combustion chamber.

4. A combustion plant according to claim 2, characterized by means (30) for introducing an absorbent into the combustion chamber (1), and that said recovery means (31) are arranged to heat the absorbent before it is fed into the combustion chamber.

5. A combustion plant according to claim 2, characterized by a circuit conduit (52) which is arranged to conduct a medium between said cooling means (45) and said recovery means (21, 31), the cooling means being arranged to transmit the heat of the product to said medium, and the recovery means (21, 31) being arranged to emit the heat of the medium.

6. A combustion plant according to claim 1, characterized in that the discharge conduit (44) comprises a discharging device (46–50) which is arranged to make a continuous discharge of the combustible product from the gasifying device (40) possible.

7. A combustion plant according to claim 6, characterized in that the discharge conduit (44) and said cooling member (45) are arranged upstream of the discharging device (46–50).

8. A combustion plant according to claim 6, characterized in that the discharging device (46–50) comprises a first valve member (47), a container (48) arranged downstream of the first valve member, and a second valve member (49) arranged downstream of the container.

9. A combustion plant according to claim 1, characterized by an additional combustion device means (11, 14, 19) for controlling the temperature of the combustion gases possible through a combustion of the combustible gas.

10. A combustion plant according to claim 9, characterized by a channel member (8) which is arranged to conduct said combustion gases from the combustion chamber (1) to one or more gas turbines (12, 13) for an extraction of energy therefrom, and that the additional combustion device means (11, 14) is arranged in the channel member upstream of at least one of the gas turbines.

11. A combustion plant according to claim 9, characterized in that the combustion chamber (1) is enclosed in a pressure vessel (2) and that the additional combustion device means comprises a burner (19) which is arranged to accomplish a combustion in the combustion chamber in a space (7) downstream of the bed.

12. A combustion plant for a combustion process, comprising a pressurized combustion chamber (1) which encloses a fluidized bed and in which combustion of a fuel is to take place while producing combustion gases, a gasifying device (40) which is arranged to produce a combustible gas and a degassed combustible product, and a transportation means (6, 44) for discharging said product from the gasifying device (40) and supplying it to the combustion chamber (1) for combustion of the product in the combustion chamber, wherein said transportation means comprises a discharge conduit (44) connected to the gasifying device (40) and arranged to discharge said product from the gasifying device (40), characterized in that the discharge conduit (44) comprises at least one cooling member (45), which is arranged to cool said product which is discharged from the gasifying device (40), and a pneumatic supply conduit means (6), arranged downstream of said cooling member (45), for connecting the discharge conduit (44) to the combustion chamber (1) and supplying said product to the combustion chamber using a pressurized gas containing oxygen supplied directly to the supply conduit means (6) by a compressor (16, 51) wherein the heat extracted from the product by the cooling member is used to heat the fuel before the fuel is combined with the product, in the supplying conduit means and thereafter provided together with the product to the combustion chamber.

* * * * *